US007350943B1

(12) United States Patent
Swanson

(10) Patent No.: US 7,350,943 B1
(45) **Date of Patent: *Apr. 1, 2008**

(54) FLOOR LAMP HAVING LOW LIGHT REPLACEABLE BULB

(75) Inventor: Dennis K. Swanson, Chatsworth, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/031,135

(22) Filed: Jan. 6, 2005

Related U.S. Application Data

(63) Continuation-in-part of application No. 10/449,498, filed on May 30, 2003, now Pat. No. 6,916,108.

(51) Int. Cl.
*F21S 8/08* (2006.01)

(52) U.S. Cl. ..... 362/410; 362/414; 362/431; 362/249; 362/641

(58) Field of Classification Search ..... 362/410, 362/414, 431, 641, 644, 236, 242, 248, 249, 362/252, 375, 351
See application file for complete search history.

(56) References Cited

U.S. PATENT DOCUMENTS

| | | | | | |
|---|---|---|---|---|---|
| 1,863,607 | A * | 6/1932 | Sabath | 362/412 |
| 2,945,948 | A * | 7/1960 | Maffei | 362/228 |
| 3,025,392 | A * | 3/1962 | Worth | 362/362 |
| 4,626,972 | A * | 12/1986 | Wolf | 362/251 |
| 5,122,942 | A * | 6/1992 | Lee | 362/353 |
| D356,387 | S * | 3/1995 | Schwartz | D26/94 |
| 5,473,525 | A * | 12/1995 | Stout | 362/412 |
| 5,642,930 | A * | 7/1997 | Brown, Sr. | 362/124 |
| 5,806,973 | A * | 9/1998 | Porter | 362/412 |
| 6,322,228 | B1 * | 11/2001 | Feldman | 362/84 |
| 6,916,108 | B2 * | 7/2005 | Swanson | 362/410 |
| 2003/0007360 | A1 * | 1/2003 | Hsieh | 362/411 |

* cited by examiner

*Primary Examiner*—Thomas M. Sember
(74) *Attorney, Agent, or Firm*—Billy A. Robbins; Connolly Bove Lodge & Hutz LLP

(57) ABSTRACT

A lamp having at least a portion of a body formed of translucent material defining a hollow chamber within which a low light level light bulb is housed. A portion of the body is removable to provide easy access to the light bulb for removal and changing when required.

5 Claims, 8 Drawing Sheets

FLOOR LAMP HAVING LOW LIGHT REPLACEABLE BULB

RELATED APPLICATION

This application is a continuation-in-part of application Ser. No. 10/449,498 filed May 30, 2003 now U.S. Pat. No. 6,916,108 by the same inventor and assigned to the same assignee.

FIELD OF THE INVENTION

This invention relates generally to lamps and more particularly to a lamp which includes a general-area lighting means and, in addition, includes a low light level lighting means and is directed specifically to a structure permitting easy replacement of the low light level light bulb.

BACKGROUND OF THE INVENTION

Floor lamps, desk lamps and table lamps are all very well known in the lighting industry. Many of such lamps contain multi-position switches for changing the level of illumination provided by the general area lighting means incorporated within such lamps. Low light level lamps, commonly referred to as night lights, are also well known in the lighting industry and are constructed having many different configurations. It is also known in the prior art to incorporate a low light level light bulb into a table lamp, floor lamp or desk lamp. In many instances, the incorporation of the low light level light bulb accomplishes the additional function of providing a more decorative appearance to the body of the lamp. The present invention is specifically directed to a lamp, which can be a desk lamp, table lamp or floor lamp, of the type which also incorporates as an integral part thereof a low light level bulb housed within the body of the lamp to provide decoration as well as a night light function. In such prior art structures, it is extremely difficult to replace the low light level light bulb when it has burned out. Prior art lamps of this type generally require extensive dismantling of the lamp to gain access to the interior of the lamp to replace the low light level light bulb. In one such prior art lamp the base had to be removed to replace the bulb.

Therefore, there is need in the lighting industry for a floor lamp which incorporates both a general area lighting means and a low light level light bulb (night light) which also provides a means for ready access to the low light level light bulb so that it may be easily changed when such is required.

SUMMARY OF THE INVENTION

A floor lamp having a low light level bulb housed within a hollow chamber which includes an enclosure defining the hollow chamber and means for supporting the bulb within the chamber. The enclosure defining the hollow chamber is carried by a stem and is disposed intermediate a base and a shade of the floor lamp. At least a portion of the enclosure is formed of translucent material and the lamp includes means in the enclosure for providing access to the low light level bulb to change the bulb.

DETAILED DESCRIPTION

A lamp constructed in accordance with the principles of the present invention provides general area lighting and at the same time includes a low light level illumination bulb such as a night light which is contained within the body of the lamp and when illuminated provides both a decorative feature for the lamp and a night light function. This is accomplished by having the body of the lamp constructed from translucent material or alternatively having portions thereof constructed of translucent material. A multi-way switch is incorporated as a part of the lamp's structure so that the general area lamp or the night light or both may be energized as desired. The low illumination level light bulb is easily replaceable by removing a locking ring and lifting a portion of the body to gain access to the bulb which may then be replaced and reinserted into the lamp after which the top and the locking ring are reassembled. The night light portion of the lamp in accordance with the present invention may be utilized on any type of lamp structure such for example as a desk lamp, a table lamp or a floor lamp without departing from the spirit or scope of the present invention.

Figure 1:
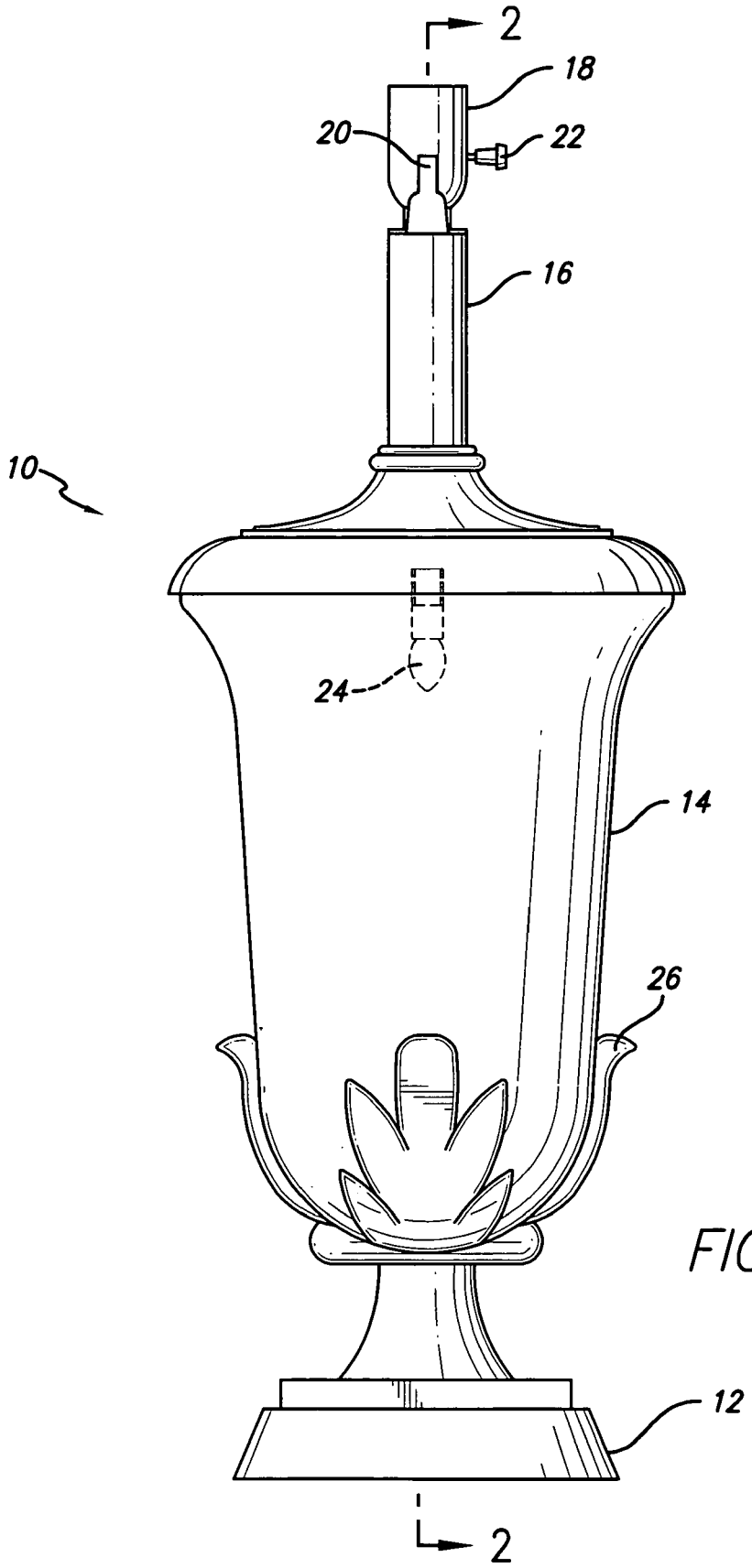
FIG. 1 is a plan view of a table or desk lamp constructed in accordance with the principles of the present invention.

One form of a lamp constructed in accordance with the principles of the present invention is illustrated in FIG. 1 to which reference is hereby made. As is therein shown a table lamp 10 includes a pedestal 12 which supports a body 14. Extending upwardly from the body 14 is a tubular member 16 which supports a light socket 18 for receiving a typical light bulb (not shown) for use as a general area lighting means. A saddle 20 is affixed to the member 16 and receives the typical wire lampshade support (not shown). A low illumination light bulb (night light) 24 is disposed internally of the body 14 as indicated by the dashed lines. The body 14 is constructed of translucent material such as plastic, glass, fabric or the like depending upon the particular design criteria and decorative environment in which the lamp is to be utilized. In accordance with a preferred embodiment of the present invention the body 14 is constructed of translucent glass and is supported within a decorative fixture 26 carried by the pedestal 12. It should be expressly understood that the pedestal 12 may be eliminated and the stem of a floor lamp substituted for it with the pedestal then being the terminus of the floor lamp and upon which the floor lamp is supported during use.

Figure 2A:
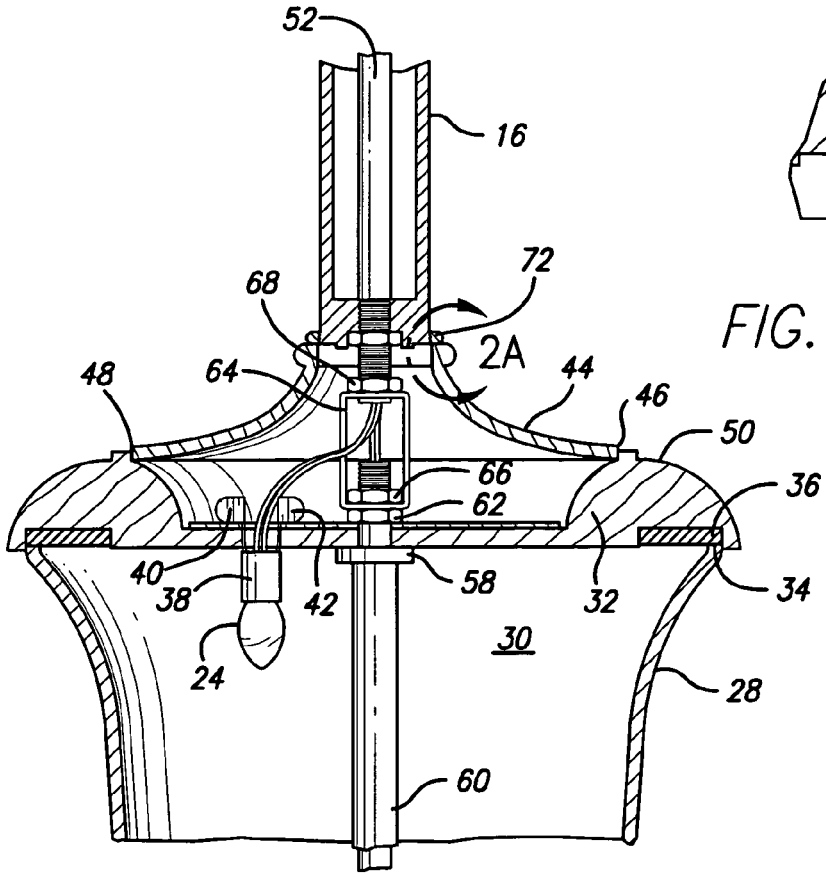
FIG. 2A is a fragmentary view showing the securing ring.
Figure 2A:
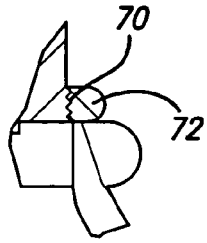
Figure 2:
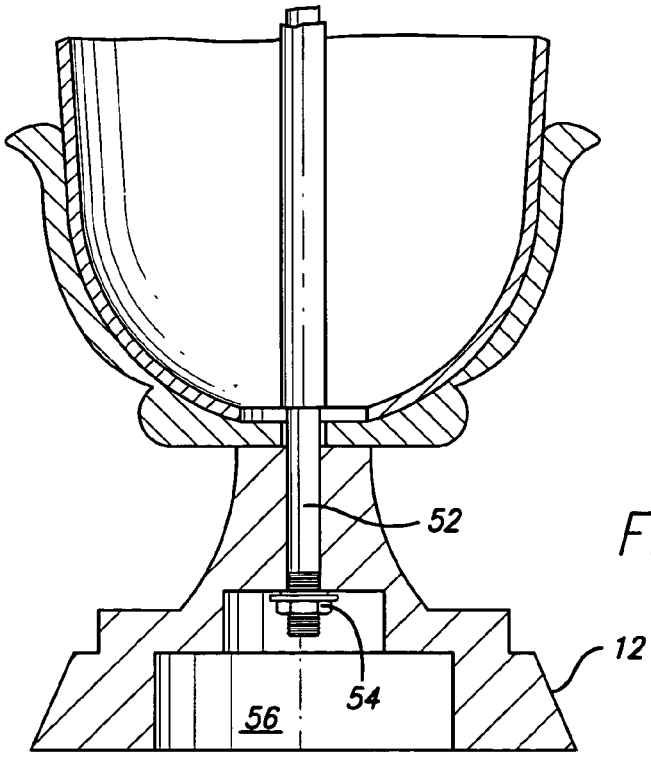
FIG. 2 is a partial cross-sectional view of the lamp illustrated in FIG. 1, taken about the lines 2-2 thereof.

The construction of the lamp constructed in accordance with the principles of the present invention is illustrated in more detail in FIG. 2. The body 14 includes an enclosure 28 defining a hollow chamber 30. The bulb 24 is disposed internally of the chamber 30. The chamber 30 is essentially closed at the top thereof by a member 32 which is supported upon the upper edge 34 of the enclosure 28. An appropriate gasket or similar elastomeric material 36 is contained about the periphery of the upper most part of the enclosure. The elastomeric material 36 cushions the contact between the upper portion 34 of the enclosure 28 and the member 32. The bulb 24 is contained within a typical light bulb socket 38 which has a pair of clips 40 and 42 affixed thereto. Preferably the enclosure 28 is constructed of material which is translucent in nature to allow a low light level to be emanated from the lamp 10 when the bulb 24 is illuminated. Alternatively the enclosure 28 may be constructed of material which is partially opaque and partially translucent to provide desired decorative affects depending upon the environment in which the lamp 10 is to be used. A top plate cap 44 includes a periphery 46 which is seated on a ledge or within a groove 48 formed upon the upper surface 50 of the member 32.

Disposed within the chamber and extending between the pedestal 12 and the socket 18 is a hollow conduit 52 which receives electrical wires. The conduit is held in place by an appropriate washer and nut combination 54 disposed within a cavity 56 defined by the pedestal 12. At the opposite end of the chamber 30 there is provided a washer or spacer member 58 which is supported on top of a sleeve 60 surrounding the conduit 52. The conduit extends through a central orifice in the member 32 and is secured in place by an appropriate nut 62 which also functions to hold the member 32 in place on top of the enclosure 28. As illustrated, the conduit 52 is separated into two portions with the upper portion extending through the extension 16 and being supported upon a bracket 64 which is held in place with an additional nut 66 thus securing the bracket in its lower most portion between the nuts 62 and 66. An additional nut 68 secures a lower end of the upper section of the conduit 52 to the top of the bracket 64. As is illustrated, the extension 16 is also threaded onto the lower threaded portion of the conduit 52.

The lower outer periphery of the extension 16 is threaded as shown at 70 in FIG. 2A. The threads 70 receive a solid ring 72 which is used to lock the top plate 44 in place for normal use of the lamp 10. This ring, however, may be turned preferably in a counter-clockwise rotational direction to release it from the threads 70, thus allowing the solid ring 72 to move upwardly over the outer surface of the extension 16. When such occurs, the top plate 44 may then be moved upwardly by grasping the upper portion thereof. When such occurs, the top plate 44 is moved away from the upper member 32 of the enclosure, thus allowing access to the clips 40 and 42.

Figure 3:
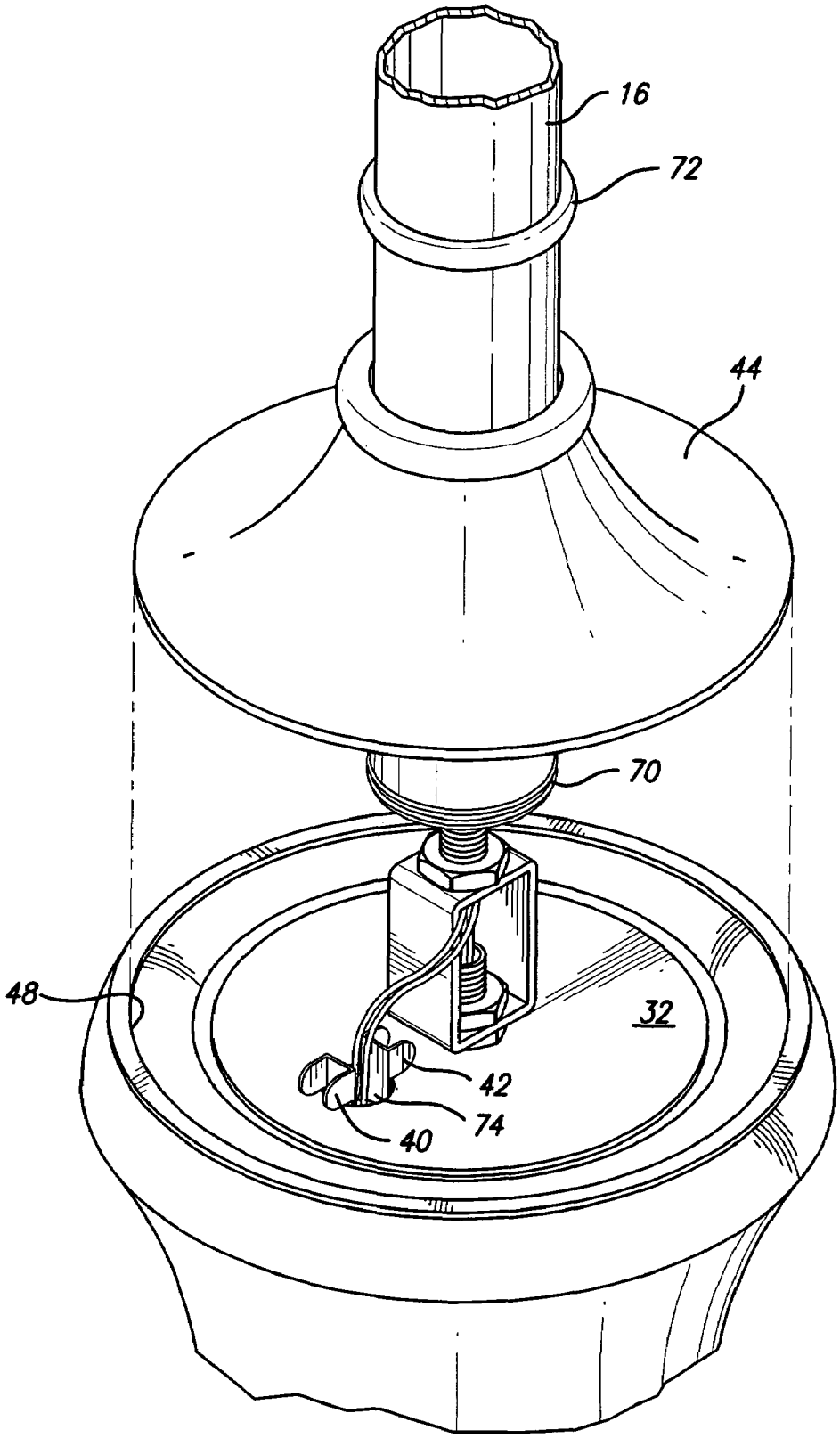
FIG. 3 is a partial perspective view of the lamp of FIG. 1 with the upper portion removed therefrom.

This operation is better illustrated in FIG. 3, to which reference is hereby made. As is therein illustrated, the solid ring 72 has been unscrewed from the threads 70 on the bottom portion of the extension 16. The top plate 44 has then been moved upwardly from its seat 48 thus exposing the clips 40 and 42. By compressing the clips 40 and 42 inwardly, the bulb 24 and its socket 38 may be removed through the opening 74 provided in the member 32, which bridges the upper surface of the enclosure 28 to define the chamber 30.

Figure 4:
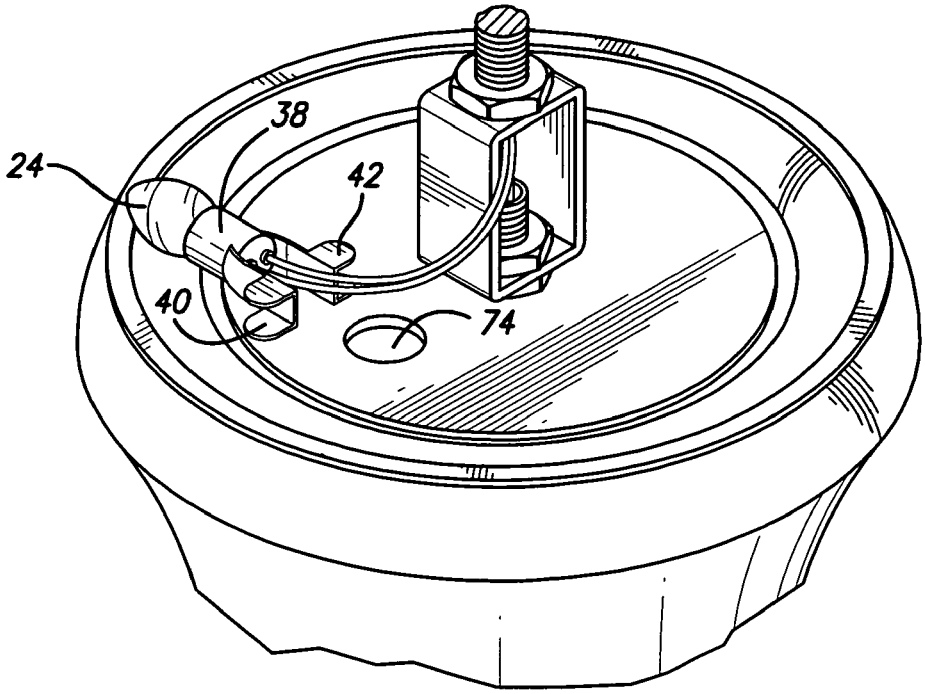
FIG. 4 is a partial view of the lamp shown in FIG. 2, illustrating removal of the low light level light bulb from the structure.
Figure 5:
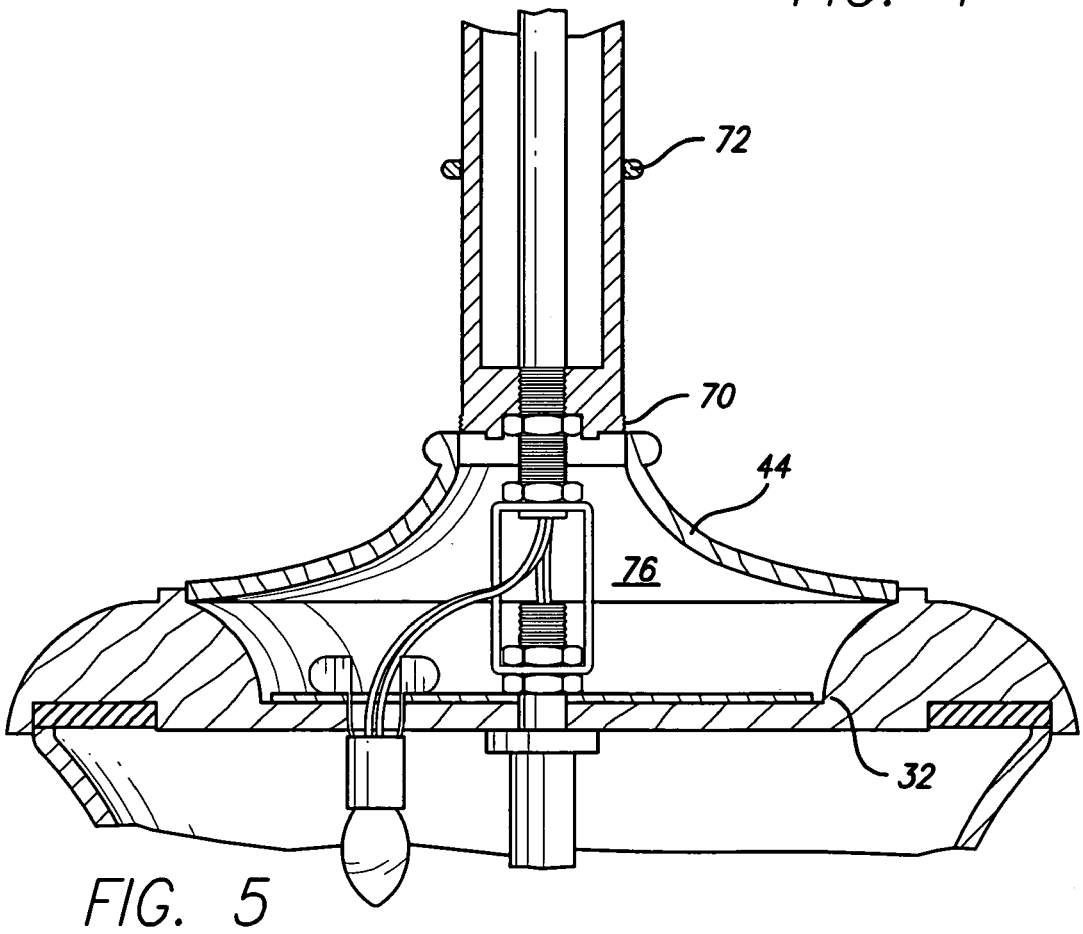
FIG. 5 is a partial cross-sectional view of the upper portion of the lamp housing the low light level bulb.

As is clearly shown in FIG. 4, the light socket 38 is formed with the clips 40 and 42 secured thereto. The clips are formed from spring metal so that when pressure is released the clips 40 and 42 will move outwardly, that is, away from the central axis of the light socket 38 in such a way that they will engage the periphery of the opening 74 defined by the upper member 32. By so doing, the bulb 24 is secured in place internally of the chamber 32 to function as a traditional night light. As is clearly shown in FIG. 5, the combination of the member 32 and the top plate 44 provides an adequate cavity 76 for receiving the night light socket and clips without interference from the structure defining the chamber and the top plate. As is clearly illustrated in FIG. 4, when the clips 40 and 42 are pressed together, the socket 38 and its bulb 24 may easily be removed from the chamber 30 by extracting it through the opening 74 defined by the member 32. The bulb 24 may then be changed as desired and by reversing the procedure, that is, inserting the bulb 24 and the socket 38 through the orifice 74 and allowing the clips 40 and 42 to naturally extend outwardly, the bulb is then replaced within the chamber 30 for its normal functioning as a night light or decoration.

Figure 6:
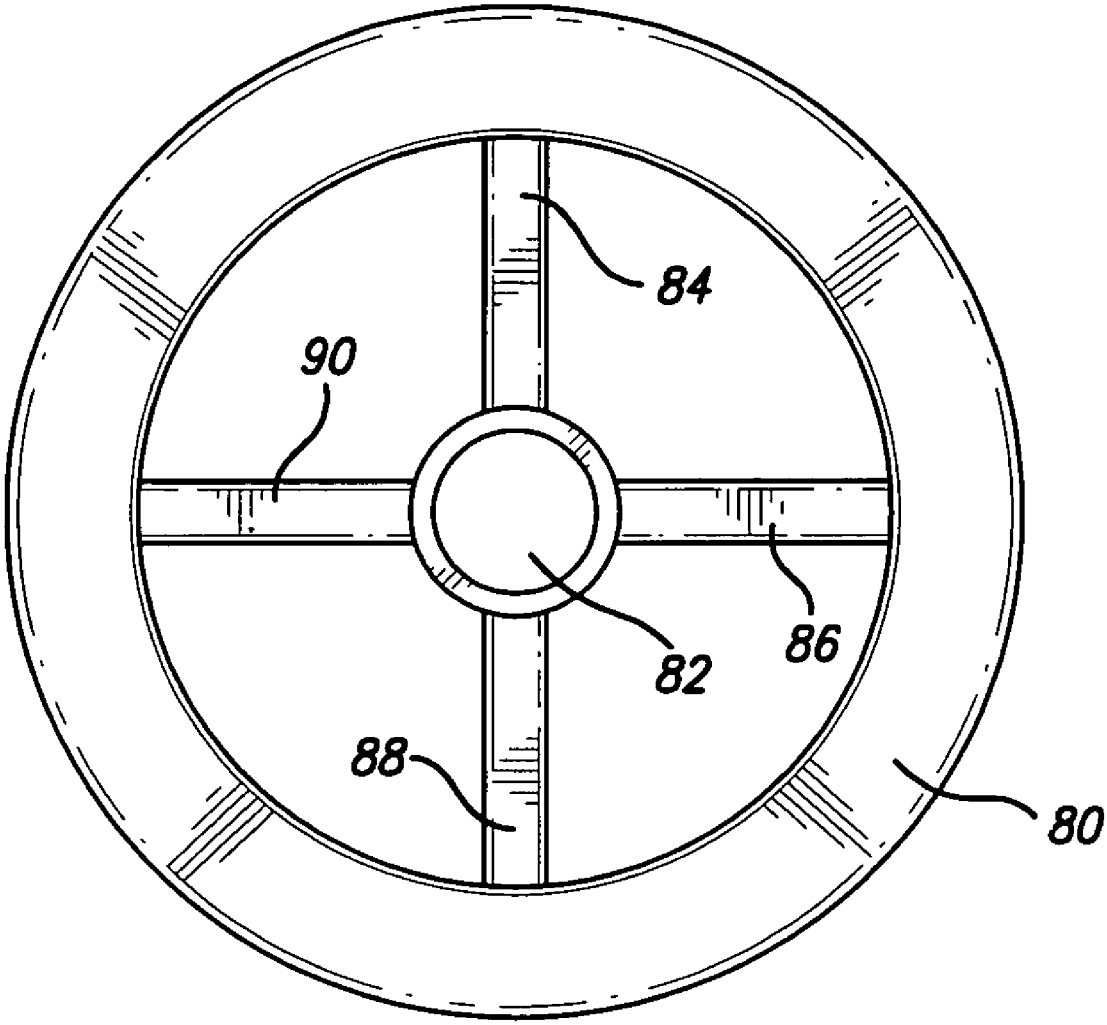
FIG. 6 is a plan view of an alternative embodiment of a member for supporting the low light level light bulb.

Although the upper member 32 which provides a means for supporting the lamp 24 is illustrated as a solid disk defining an orifice for receiving the bulb, it should be understood that any number of additional configurations of such a supporting means for the lamp may be utilized. One alternative member is shown in FIG. 6, to which reference is hereby made. As is therein indicated, there is provided a ring 80 having a center section 82 with a plurality of spokes 84, 86, 88 and 90 interconnecting the center section 82 and the rim 80. The structure as shown in FIG. 6 may be substituted for the central disk-like portion of the member 32 by providing a ledge or seat within which it can be received. The lamp socket 38 may then be provided with a hook-type structure which could be placed over one of the ribs 84 through 90 to allow the bulb 24 to extend into the chamber 30. It would be obvious to those skilled in the art that through the utilization of a structure such as shown in FIG. 6, when the top plate 44 is removed as above described, one may simply reach in and unhook the light socket and burned-out bulb and replace the burned-out bulb as desired.

As is clearly evident in the various drawings, electrical wiring is contained within the conduit 52 and would extend upwardly to the light socket 18.

The invention thus far described has been with regard to a table lamp which incorporates as an integral part thereof a readily accessible night light in the body thereof. Since the present invention is applicable both to table lamps and floor lamps, the remaining description of the invention will be directed to various embodiments of the invention as incorporated into floor lamps of various types.

Figure 7:
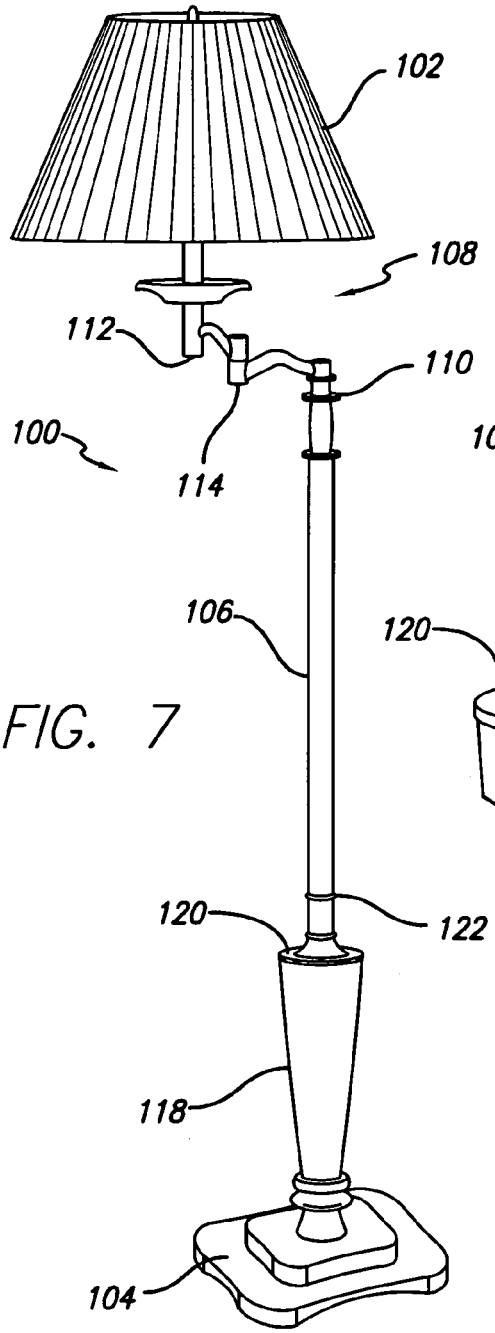
FIG. 7 is a perspective view of one embodiment of a floor lamp constructed in accordance with the principles of the present invention.
Figure 9:
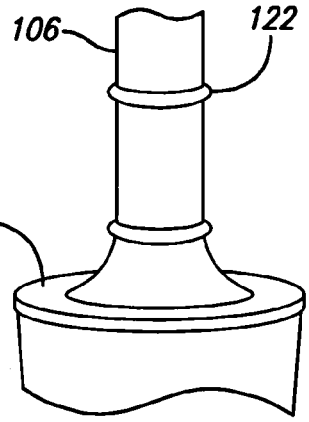
FIG. 9 is a fragmentary view showing a feature of the lamps of FIGS. 7 and 8.

Referring now more specifically to FIG. 7, there is illustrated a floor lamp 100 which includes a shade 102 and a base 104. A stem 106 is interconnected between the shade 102 and the base 104. The shade 102 is a typical floor lamp downwardly-directed shade which is affixed to the upper end of the stem 106 with a swing arm 108 thus allowing the shade 102 to be placed to various positions to accommodate the desires of the user. The swing arm 108 is connected to the stem 106 by a swivel 110 and to the shade 102 by an additional swivel 112 with the swing arm 108 being articulated in that it is comprised of two segments interconnected by an additional swivel 114. An enclosure 118 is carried by the stem 106 and is interposed intermediate the base 104 and the shade 102. The enclosure 118 defines a hollow chamber within which there is disposed a night light much as is illustrated in FIG. 2. The enclosure 118 includes a removable cap 120 which is constructed in such a manner as to provide a decorative portion of the stem 106. To obtain access to the night light which is disposed within the enclosure 118, a ring 122 is unscrewed from threads appearing on the stem 106 at the upper end of the cap 120, as more clearly illustrated in FIG. 9, once the ring is unscrewed it may be moved upwardly along the stem 106 as shown in FIG. 9, thus allowing the cap 120 to be moved upwardly along the stem 106 to provide access to the night light so that it may be removed from the enclosure 118 and replaced when such is desired. The structure of the night light and the manner in which it is removed and replaced is substantially the same as above described and illustrated.

Figure 8:
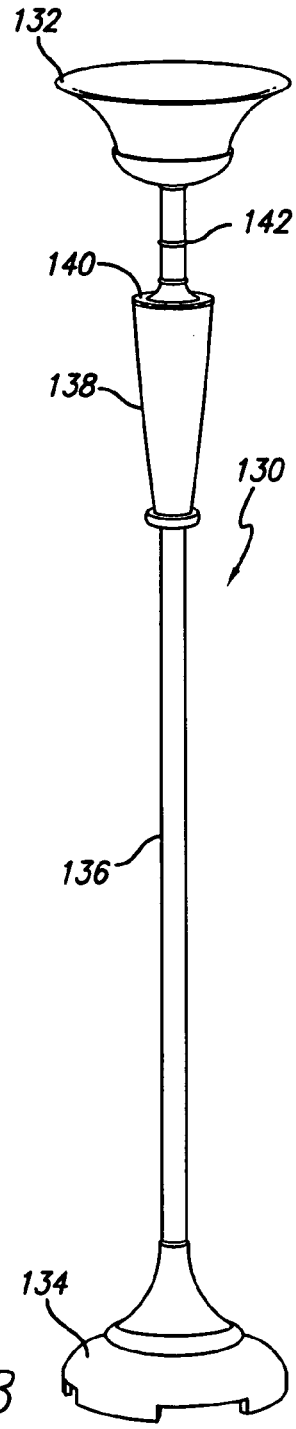
FIG. 8 is a perspective view of another embodiment thereof.

Referring now to FIG. 8, there is illustrated a floor lamp 130 which is a torchiere type of floor lamp, which includes a shade 132 and a base 134 with a stem 136 interconnected between the base 134 and the shade 132. The stem carries an enclosure 138 which defines a hollow chamber and is disposed intermediate the shade 132 and the base 134. As is shown in FIG. 8, the enclosure 138 is positioned adjacent the shade 132 while in the floor lamp of FIG. 7 the enclosure 118 is positioned adjacent the base 104. Such positioning illustrates that the enclosure housing the night light may be disposed at any desired position along the stem of the floor lamp to provide the desired effect both from a utilitarian and an aesthetic point of view.

To provide access to the night light which is disposed internally of the enclosure 138 there is provided a removable cover 140 at the upper end of the enclosure 138. A ring 142 may be unscrewed and moved upwardly along the stem 136 to thereby permit the cap 140 to be moved upwardly along the stem 136 to provide access to the night light which is disposed internally of the enclosure 138. This structure is identical to that shown in FIG. 9 and above described.

Figure 10:
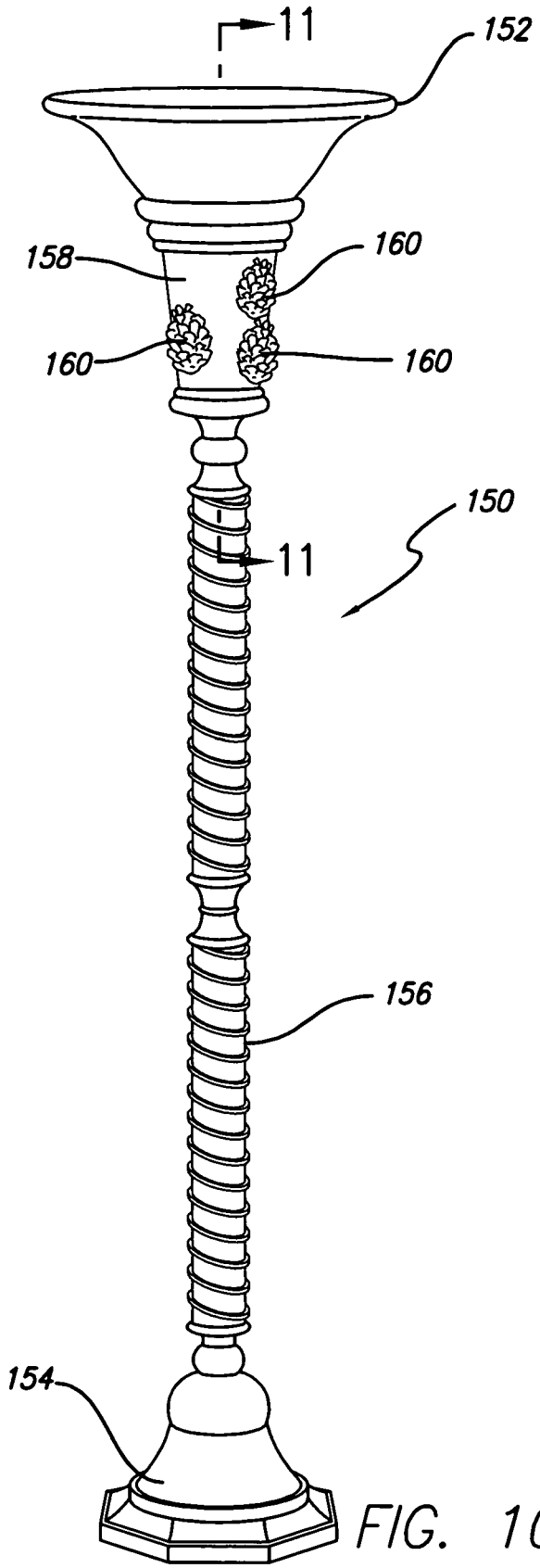
FIG. 10 is a perspective view of a further embodiment of a floor lamp constructed in accordance with the principles of the present invention.
Figure 11:
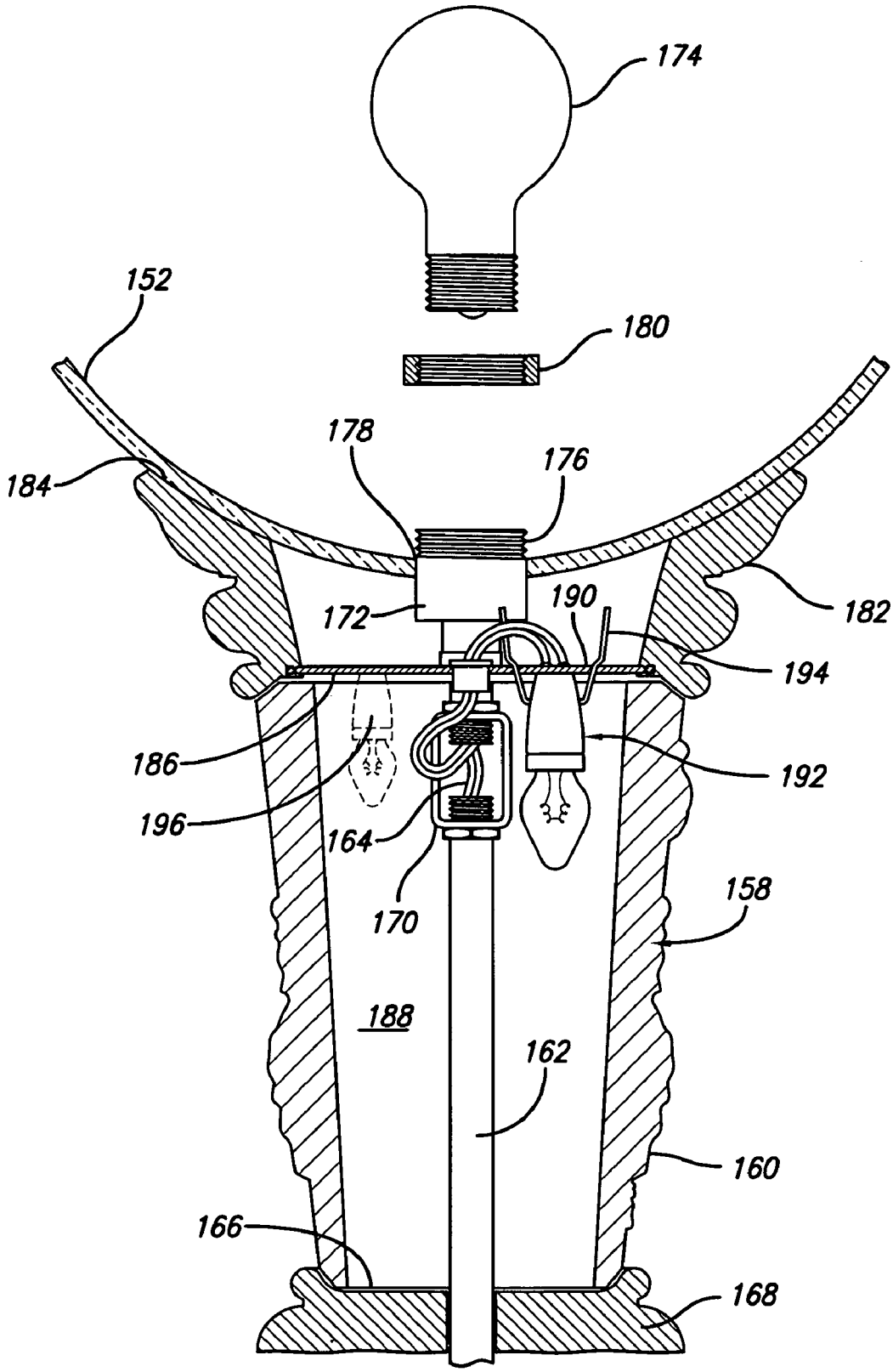
FIG. 11 is a cross-sectional view of a portion of the lamp of FIG. 10 taken about the lines 11-11 thereof.

Referring now more specifically to FIG. 10, there is shown yet another embodiment of a floor lamp constructed in accordance with the principles of the present invention. As is therein illustrated, the floor lamp 150 is a torchiere lamp having a shade 152 and a base 154. A stem 156 interconnects the shade 52 and the base 54. An enclosure 158 is carried by the upper end of the stem 156 and defines a hollow chamber within which one or more night lights is disposed. As is clearly illustrated in FIG. 10, the enclosure 158 forms the uppermost portion of the stem 156 and is formed to have decorative protuberances in the form of pine cones 160 or the like thereon to provide an aesthetic appearance. The manner in which access to the night light housed within the enclosure 158 is somewhat different than that as described with regard to the lamp structures above illustrated and described. By reference now more particularly to FIG. 11, the manner in which the enclosure is formed and in which access to the night light is obtained is illustrated in greater detail. As is therein shown, the enclosure 158 is preferably formed of a molded plastic material and as above described, the outer surface may contain various ornamental features 160. Extending centrally through the enclosure 158 is a hollow metal conduit 162 through which the electrical wiring 164 passes as is well known. The enclosure 158 is seated at its lower end 166 upon a molded terminus 168 of the stem 156. Attached to the conduit 162 is an appropriate fitting 170 as is well known to those skilled in the art, which is utilized to support a socket 172 in which the light bulb 174 is received. The socket 172, however, is specially formed in that at the upper end thereof there are provided threads 176 which preferably are molded in place. The shade 152 has an opening 178 therein which permits it to be passed over the outer periphery of the socket 172. After being so positioned, a threaded ring 180 is threadably received upon the threads 176 to thereby hold the shade 152 in place. A top 182 is formed to be received at the upper end of the enclosure 158 and is contoured as illustrated at 184 to receive the shade 152. A plate 186 is secured within the top 182 and effectively closes the top of the member 158 to thus provide a chamber 188. The plate or member 186 defines an opening 190 therein through which the night light 192 is extended and is held in place by the compressible clips 194 in the manner as above described.

It should now become apparent to those skilled in the art that when the light bulb of the night light 182 burns out and is to be replaced, that such is accomplished in the torchiere lamp 150 by removing the light bulb 174 from the socket 172, turning the ring 180 counter-clockwise to disengage it from the threads 176, removing the shade 152 from around the socket 172. When such is accomplished, access to the clips 194 is provided. At that point, the clips can be squeezed together and the night light 192 removed from the chamber 188 and the bulb replaced all in the manner as described previously with regard to FIGS. 3, 4 and 5. If desired, an additional night light 196 as shown in dash lines may be provided through an additional opening in the plate 186 to provide greater illumination.

There is thus disclosed a lamp which may be utilized as a desk lamp, table lamp or floor lamp, which includes a combination of a general area lighting means and a low level light illumination means (night light), which is constructed in such a manner that the night light is contained within an enclosed chamber but is readily accessible for changing the night light bulb when such is required.

What is claimed is:

1. A floor lamp having a night light comprising:

(a) a base for supporting said floor lamp upon a floor;

(b) a stem having a first end and a second end, said first end being connected to said base so that said stem extends upwardly away from said floor;

(c) a shade, including illuminations connected to said second end of said stem for providing general area lighting;

(d) an enclosure defining a hollow chamber having an upper end carried by said stem and disposed upwardly away from said base and intermediate said first and second ends, at least a part of said enclosure being translucent;

(e) a low light level bulb;

(f) means extending over said upper end of said chamber for supporting said low light level bulb within said chamber;

(g) a removable cap having a central opening therein disposed over the upper end of said enclosed hollow chamber;

(h) said stem extending through said opening in said cap, said stem defining external threads adjacent and above said cap; and (i) a threaded ring threadably received on said threads on said stem to secure said cap in place, whereby when said ring is threadably removed from said threads, said cap may be moved away from said upper end of said enclosed hollow chamber for allowing easy access to said low light level bulb.

2. A lamp as defined in claim 1 wherein said means extending over said upper end of said chamber is a disk.

3. A lamp as defined in claim 2 wherein said disk defines an orifice therein for receiving said bulb.

4. A lamp as defined in claim 3 which further includes a resiliently deformable clip engaging said disk at said orifice to support said bulb within said chamber.

5. A lamp as defined in claim 4 which further includes a socket for receiving said bulb and said clip is carried by said socket.

* * * * *